US005630258A

United States Patent [19]

Schneider

[11] Patent Number: 5,630,258

[45] Date of Patent: May 20, 1997

[54] MAGNETIC BUCKLE

[76] Inventor: John R. Schneider, 4 Woodside Dr. East, Apalachin, N.Y. 13732

[21] Appl. No.: 511,787

[22] Filed: Aug. 7, 1995

[51] Int. Cl.[6] ..... A44B 21/00

[52] U.S. Cl. ..... 24/303; 292/251.5

[58] Field of Search ..... 24/303, 66.1; 292/251.5; 403/DIG. 1; 335/285; 70/459; 446/129, 130, 131, 132

[56] References Cited

U.S. PATENT DOCUMENTS

| | | | |
|---|---|---|---|
| 2,615,227 | 10/1952 | Hornik | 24/303 |
| 2,615,738 | 10/1952 | Johnson | 403/DIG. 1 |
| 2,812,203 | 11/1957 | Scholten . | |
| 2,901,278 | 8/1959 | Robinson . | |
| 3,009,225 | 11/1961 | Budreck . | |
| 3,041,697 | 7/1962 | Budreck . | |
| 3,141,216 | 7/1964 | Brett . | |
| 3,326,587 | 6/1967 | Reiss | 292/251.5 |
| 3,409,295 | 11/1968 | Bernstein | 446/129 |
| 3,425,729 | 2/1969 | Bisbing | 292/251.5 |
| 4,310,188 | 1/1982 | Aoki | 292/251.5 |
| 4,941,236 | 7/1990 | Sherman et al. | 24/303 |
| 5,099,659 | 3/1992 | Carranza et al. | 24/303 |
| 5,125,134 | 6/1992 | Morita | 24/303 |

FOREIGN PATENT DOCUMENTS

| | | | |
|---|---|---|---|
| 0170004 | 10/1983 | Japan | 335/285 |

*Primary Examiner*—Victor N. Sakran
*Attorney, Agent, or Firm*—Salzman & Levy

[57] ABSTRACT

The present invention features a magnetic assembly which has one half formed by one male magnetized part and the other half formed by one female magnetized part, both of which mate together, using very close tolerances so that there is no space noticeable between the two magnetically-closed parts. This close proximity between the two parts prevents either from being accidentally dislodged. The male post extends beyond the reverse side of the female magnet into which it has been placed, so that the user can push against the end of the male post to force it back out of the female hole. This action forces the two halves of the magnetic fastener assembly apart, allowing them to be disengaged from one another and to be able to open the fastener with the use of just one hand on the part of the user.

18 Claims, 1 Drawing Sheet

MAGNETIC BUCKLE

FIELD OF THE INVENTION

The present invention pertains to magnetic buckles and, more particularly, to magnetic buckles used to fasten the ends of a belt, which buckles can be unfastened with one hand.

BACKGROUND OF THE INVENTION

To date, the design of magnetic fastening mechanisms has depended entirely upon simple magnetic attraction. Magnetic attraction occurs within the magnetic circuit of a fastener system and holds the two halves of a fastener together, resisting the fastener's opening. Simple magnetic attraction results in an unnecessarily weak fastener system, one that, under stressful conditions, can fail and result in an unwanted opening event.

Magnetic latches have been described and produced for doors (U.S. Pat. Nos. 2,497,697; 2,812,203; 2,901,278) as well as diverse articles such as key chains, buttons and belts.

U.S. Pat. Nos. 4,989,299 and 5,142,746, both issued to MORITA; 5,042,116, issued to OSSIANI; and 4,736,494, issued to MARCHESI, all disclose fasteners or buttons in which separate halves are attracted to one another by magnetism.

U.S. Pat. Nos. 3,086,268, and 3,041,697, issued to CHAFFIN, JR. and BUDRECK, respectively, disclose magnetic connectors for key chains, wherein a rivet is used to hold a magnet and pole piece together permanently.

U.S. Pat. Nos. 3,009,225, also issued to BUDRECK and 3,141,216, issued to BRETT disclose two-part magnetic connectors in which a pair of rods, posts, or extensions are affixed to the components of the connectors for alignment.

Unfortunately, since all of the foregoing references rely on simple magnetic attraction to maintain their separate components in operable relationship with each other, undesired separation is not only possible, but likely.

It would be advantageous to provide a magnetic fastener that includes a single mechanical adjunct that extends entirely through both components for the augmentation of strength, thereby rendering the bond between the two halves of the fastener separable only by the express effort of the user.

It would further be advantageous to provide such a magnetic, mechanical fastener with a magnetic flux field to assist in the positioning of the two halves of the fastener, as they are being engaged.

It would also be advantageous to provide a magnetic fastener that can be manipulated easily, so that the user need only one hand to open and close the unit.

It would also be advantageous to provide such a magnetic fastener with linking components so quiet during operation that the fastener cannot be heard opening or closing.

It would also be advantageous to provide a fastener that is useful with buckles, buttons, clasps and other closure articles.

The present invention increases the holding power of a magnetic fastener by adding a mechanical holding component to the closure, so as to augment the magnetic attraction. This mechanical component is a single steel post attached to the first half of the magnetic assembly. The magnetic assembly is so closely fitted to a hole in the magnet in the opposite half of the fastener assembly that only an opening force directly in line with the post can cause the post to slide through and out of the hole. Only then are the two magnets separated, so that the magnetic closure assembly opens. No other force, regardless of its strength or direction, can cause the post to break the magnetic attraction of the magnetic components of the closure and thus open the magnetic fastener accidentally.

SUMMARY OF THE INVENTION

In accordance with the present invention, there is provided a magnetic fastening article such as a belt buckle for attaching two separate items or ends of a belt to each other. A plate of magnetic material has an aperture and a post extending through the aperture. The post is affixed to the plate, the major axis of the post being perpendicular to the plane of the plate. The post is made of ferrous material. A base is also provided having an upper surface and a lower surface, and having an aperture for receiving the post. When the plate is caused to come into contact with the upper surface of the base, the end of the post extends through the aperture, coming to rest at a position at least flush with the lower surface of the base.

BRIEF DESCRIPTION OF THE DRAWINGS

A complete understanding of the present invention may be obtained by reference to the accompanying drawings, when taken in conjunction with the following detailed description thereof, and in which.

The invention will be better understood and become more apparent hereinafter with reference to the detailed description. For the sake of brevity, like elements and components will bear the same numerical designations throughout the FIGURES.

DESCRIPTION OF THE PREFERRED EMBODIMENTS

Figure 1:
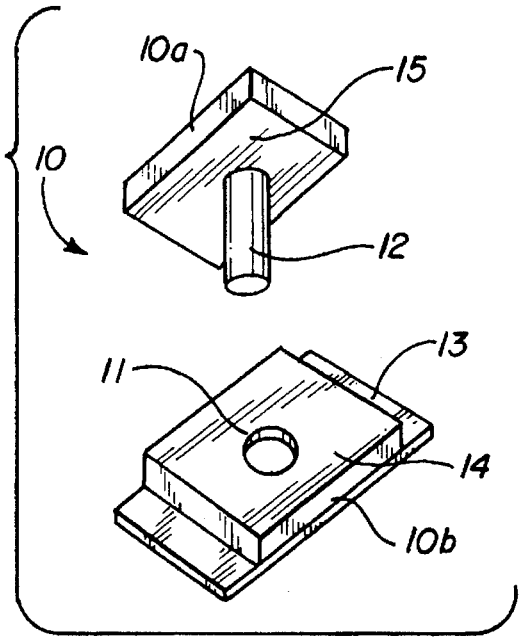
FIG. 1 is a perspective view of the magnetic fastener in accordance with the present invention in its open position.

Referring now to FIG. 1, there is shown a perspective view of the magnetic buckle in accordance with the present c invention. The buckle, shown generally as reference numeral 10, consists of a top half 10*a*, having a substantially planar plate of magnetic material 15 and protuberance 12 in the form of a steel post, and a bottom half 10*b*, having a substantially planar steel plate 13 to which is affixed a magnet 14 having an aperture or hole 11 formed therein. It should be understood that a plurality of posts and corresponding holes can be incorporated without exceeding the scope of the invention, but for clarity in this description, only one post and one hole are shown.

Figure 2:
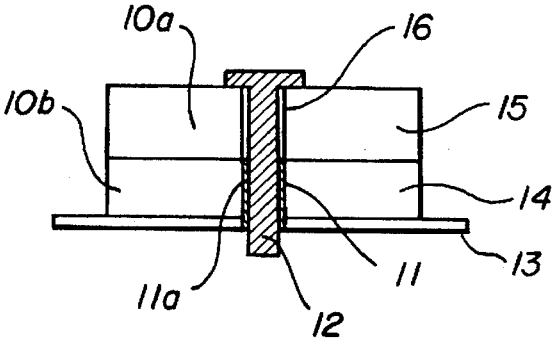
FIG. 2 is a cross-sectional side view of a complete magnetic fastener in its closed position.

Referring now also to FIG. 2, there is shown a cross-sectional, side view of the fastener in its closed position. The top half 10*a* is composed of magnet 15 and steel pole 12, while the bottom half 10*b* is composed of steel plate 13, magnet 14, and a torroidal core 11*a* disposed in aperture 11. As can be seen, identical permanent magnets 14 and 15 are provided with holes 16 and 11 cast through their respective centers. The holes 16 and 11 may be round, square, polygonal, rectangular, irregular (e.g., heart-shaped), or any other suitable shape. It should be understood that hole 16 need not be required, if plate 15 and post 12 were fabricated as one piece.

In the center hole 11 of the bottom magnet 14 is a torroidal core 11*a*, formed by winding several wraps from a strip of steel foil of a few-thousandths of an inch in thickness. The strip of thin foil is as wide as the magnet 14 is thick. The hole in the center of this wound core 11*a* is provided for the center post 12 to fit into and through, when the two halves 10*a* and 10*b* of this fastener assembly 10 are engaged. The wraps of steel in the torroidal core 11*a* are sufficiently numerous to provide a hole which allows, at most, only a few-thousandths of an inch of clearance for the post 12. In this way, the tight fit keeps the post 12 from canting sideways inside the hole 11, when an external force strikes the closed fastener assembly 10. The tight fit keeps the extraneous forces which would normally act to disengage the two magnets 14 and 15 from doing so; the tight post fit will not allow the magnets to be forced apart accidentally. Therefore, the magnets 14 and 15 remain together, where their gauss force attraction to one another is greatest.

The flux field inside the torroidal core 11*a* also functions to center the post 12 in the hole 11 so that the tight fit does not create a problem for the user, not shown, who tries to slide the post 12 therein. The post 12 is bonded to top magnet 15 via epoxy cement or other standard cementing agent. The torroidal core 11*a* is likewise bonded inside the center hole 11 of bottom magnet 14. The single, steel post 12 extends at least to the upper surface of pole piece 13 and preferably beyond the steel pole piece 13, which is bonded to the bottom side of bottom magnet 14. In this way, the user can disengage the two magnets 14 and 15 from each other by pushing against the end of the post 12, so as to force it back out of the hole in the torroidal core 11*a*. The length of the single post 12 affords a mechanical adjunct, augmenting magnetic strength and helping to ensure that the halves 10*a* and 10*b* of assembly 10 are not separated inadvertently.

The ends of the steel pole piece 13 are extended beyond the sides of the bottom magnet 14, so that the user has room to place and use several fingers during this effort of disengagement. The user places the index finger under one projecting end of steel pole piece 13 and the middle finger under the other projecting end of pole piece 13, while applying force against the end of post 12 with the thumb. This allows a one-handed disengagement of the magnetic buckle 10.

Figure 3:
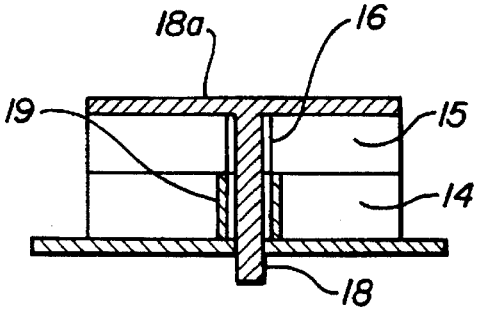
FIG. 3 is a cross-sectional side view of the complete magnetic fastener depicted in FIG. 2, with several modifications of its parts.

FIG. 3 shows the same basic design as that illustrated in FIG. 2, except that a pole piece 17, instead of being flat, has a hollow stud 19 attached thereto. This hollow stud 19 fits up into the center hole 16 of bottom magnet 14 and replaces the individual foil-wound torroidal core 11a (FIG. 2). A steel post 18 replaces post 12 (FIG. 2), the new post 18 having a head 18a that spans the entire surface of the top of the top magnet 15. This provides additional bonding surface to post 18, as well as a greater capacity to absorb flux from the magnets.

Figure 4:
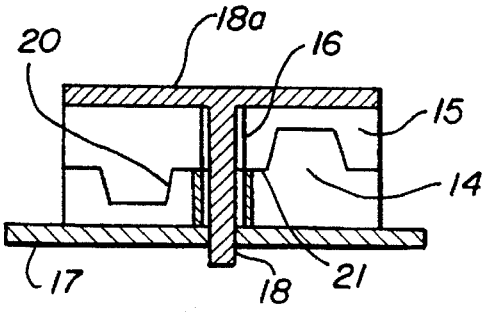
FIG. 4 is a cross-sectional view of the complete magnetic fastener depicted in FIG. 2, in which pole faces of the opposing magnets are in toothed configuration.

FIG. 4 illustrates the same basic design as seen in FIGS. 2 and 3, except that the pole faces 21 and 20 of the magnets 14 and 15, respectively, instead of being flat, have a toothed configuration. This prevents the magnets from exhibiting any tendency to rotate in relationship to each other while in closed contact therewith. It should be obvious to one skilled in the art that the designs of the various components shown in both FIGS. 2 and 3 may be interchanged and are not mutually exclusive. Also, this complete fastener design can operate successfully by using only one magnet in the magnetic circuit, and that two magnets are not the only method that will operate well in this overall concept. The magnets described in these designs could be made from any magnetic material (such as Alnico) or any ceramic material. Finally, the steel posts 12 (FIG. 2) and 18 (FIGS. 3 and 4) can also be ringed with grooves on their surfaces or possess some other, non-smooth surface finish which adds to the design's effective holding power.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A magnetic fastening article for attaching two separate items to each other, comprising:

a) a plate of magnetic material having an aperture and having a post extending through said aperture and affixed to said plate, the major axis of said post being substantially perpendicular to the plane of said plate, said post being of a predetermined length and having a tip at its distal end, and comprising ferrous material; and b) a base having an upper surface and a lower surface, and having an aperture disposed therein for receiving said post;

said predetermined length of said post being greater than the distance between said plate and said lower surface of said base when said plate and said base are juxtaposed with respect to each other, whereby, when said plate is caused to come into contact with said upper surface of said base, said end of said post extends through said aperture, coming to rest at a position beyond said lower surface of said base, so that a user can directly press said end of said post to separate said plate from said base.

2. The magnetic fastening article in accordance with claim 1, further comprising:

c) a torroidal core disposed in said aperture of said base.

3. The magnetic fastening article in accordance with claim 2, wherein said torroidal core comprises thin, ferrous, steel foil.

4. The magnetic fastening article in accordance with claim 1, wherein said base comprises magnetic material.

5. The magnetic fastening article in accordance with claim 4, wherein said upper surface of said base is irregularly shaped and said plate conforms to said irregular shape.

6. The magnetic fastening article in accordance with claim 1, wherein said base comprises ferrous material.

7. The magnetic fastening article in accordance with claim 6, wherein said upper surface of said base is irregularly shaped and said plate conforms to said irregular shape.

8. The magnetic fastening article in accordance with claim 1, wherein said tip of said post is rounded to facilitate insertion of said post through said aperture of said base.

9. The magnetic fastening article in accordance with claim 1, wherein said lower surface of said base extends beyond said upper surface thereof, so that said user can place at least one finger thereupon while disengaging said plate from said base.

10. A magnetic fastening article for attaching two separate items to each other comprising:

a) a plate of magnetic material having a post, the major axis of said post being substantially perpendicular to the plane of said plate, said post being of a predetermined length and having a tip at its distal end, and comprising ferrous material; and b) a base having an upper surface and a lower surface, and having an aperture disposed therein for receiving said post;

said predetermined length of said post being greater than the distance between said plate and said lower surface of said base when said plate and said base are juxtaposed with respect to each other, whereby, when said plate is caused to come into contact with said upper surface of said base, said end of said post extends through said aperture, coming to rest at a position beyond said lower surface of said base, so that a user can directly press said end of said post to separate said plate from said base.

11. The magnetic fastening article in accordance with claim 10, further comprising:

c) a torroidal core disposed in said aperture of said base.

12. The magnetic fastening article in accordance with claim 11, wherein said torroidal core comprises thin, ferrous, steel foil.

13. The magnetic fastening article in accordance with claim 10, wherein said base comprises magnetic material.

14. The magnetic fastening article in accordance with claim 13, wherein said upper surface of said base is irregularly shaped and said plate conforms to said irregular shape.

15. The magnetic fastening article in accordance with claim 10, wherein said base comprises ferrous material.

16. The magnetic fastening article in accordance with claim 15, wherein said upper surface of said base is irregularly shaped and said plate conforms to said irregular shape.

17. The magnetic fastening article in accordance with claim 10, wherein said tip of said post is rounded to facilitate insertion of said post through said aperture of said base.

18. The magnetic fastening article in accordance with claim 10, wherein said lower surface of said base extends beyond said upper surface thereof, so that said user can place at least one finger thereupon while disengaging said plate from said base.

* * * * *